United States Patent [19]

King et al.

[11] 4,325,309

[45] Apr. 20, 1982

[54] BLAST SUPPRESSIVE SHIELDING

[75] Inventors: Paul V. King, Joppatowne; Albert P. Becher, Fallston; Wilmer P. Henderson, Bel Air, all of Md.

[73] Assignee: The United States of America as represented by the Secretary of the Army, Washington, D.C.

[21] Appl. No.: 75,770

[22] Filed: Sep. 17, 1979

Related U.S. Application Data

[60] Division of Ser. No. 699,738, Jun. 24, 1976, abandoned, which is a continuation of Ser. No. 495,177, Aug. 6, 1974, abandoned.

[51] Int. Cl.[3] ..... F41H 5/00; E05G 1/00

[52] U.S. Cl. ..... 109/49.5; 89/36 R

[58] Field of Search ..... 109/49.5, 78, 80, 85; 89/36 R, 36 C, 1 R; 86/1 R; 102/22

[56] References Cited

U.S. PATENT DOCUMENTS

| | | | |
|---|---|---|---|
| 1,086,708 | 2/1914 | Hoagland | 89/36 R |
| 2,743,035 | 4/1956 | Fogarty | 89/36 R |
| 3,504,644 | 4/1970 | Schibisch | 109/49.5 |

*Primary Examiner*—Reinaldo P. Machado

*Attorney, Agent, or Firm*—Nathan Edelberg; Robert P. Gibson; A. Victor Erkkila

[57] ABSTRACT

Manufactures, apparatus and processes for shielding the hazards of explosives, pyrotechnics and propellants during manufacture, demolition, demilitarization storage, transportation and use.

15 Claims, 16 Drawing Figures

BLAST SUPPRESSIVE SHIELDING

GOVERNMENTAL INTEREST

The invention described herein may be manufactured and used by or for the Government for Governmental purposes without the payment of any royalties to us thereon or therefor.

CROSS-REFERENCE TO RELATED APPLICATIONS

This application is a division of application Ser. No. 699,738, filed June 24, 1976, now abandoned, which in turn is a continuation of application Ser. No. 495,177, filed Aug. 6, 1974 and also now abandoned.

BACKGROUND OF THE INVENTION

The present invention relates generally to the field of explosives, propellants and pyrotechnics and more particularly to reducing the hazards of handling, manufacturing, storage, transporting, using and demolition of these materials.

Since the time of Nobel, much effort in research and development has been expended to develop more efficient and reliable explosives. These ends have been achieved in part, but little or no real comparable progress has been made until the instant invention in the area of hazard prevention in the manufacture, storage, transportation, demolition and demilitarization of explosives, propellants and pyrotechnics commensurate with the development of these materials.

In the manufacture of these materials the hazards were and still are being viewed as being existent and that explosive and conflagration accidents are inevitable and unavoidable. The objective, until the present invention, has been to minimize them. This has been done by providing manufacturing buildings with concrete walls 3 feet thick. Roofs and ceilings have been designed with like strength and like safety factors, or alternatively designed to blow off. Internally, certain precautions have been taken. For example, 1 foot thick concrete or cement block dividing walls have been used to partially localize accidental blasts and fires. The effects of blasts such as overpressure and the effects of rapid fires are generally vented outdoors, above the dividing walls, or through a portion of the roof which is designed to give way. One contemporary installation has an outside wall which extends from one dividing wall to the other built of frangible material so that the pressures from the blast and fires are vented therethrough. Other wall designs instead of pure concrete are also in use. The concrete walls have been reinforced with welded steel reinforcements which enables the concrete to withstand more explosive force inasmuch as it is weak in tension. Alternatively, hollow walls have been constructed and used with some success. They comprise spaced inner and outer panels of either steel or wood with sand filling the space therebetween. The assembly lines are generally segmentized in plural of the aforementioned buildings and for within each building structure. This is and has been done with safety in mind, i.e., in the event of an explosion and/or fire only one portion of the assembly line is destroyed. Within one building structure it is conventional to pass the assembly line transverse to and through these dividing walls. Through heavy wall and divider construction, a measure of hazard prevention has been had. Even in view thereof, ever present danger to personnel life and plant demolition still plagues the explosive propellant and pyrotechnic manufacturing community. This is so, because the concept of Quantity-Distance (Q-D) is still the only guide employed to protect adjacent structures against major structural damage.

In the storage of partially or fully assembled, munitions and explosives, it is and has been common practice to provide storage magazines under the earth. The magazine comprises a concrete structure with an entranceway, with walls, a floor, and a roof 2 to 3 feet thick. The roof is generally dome shaped, and the entranceway is closed by a heavy door which is designed to give way if a blast occurs. The roof is generally covered with 3 to 4 feet of packed earth. Though a measure of safety is had by these storage efforts, the possibility of explosive blasts and fires causing harm to persons and property considerable distances from the storage area still exists.

In the field of transporting explosives, propellants, pyrotechnics and munitions, where the material or the munition either has deteriorated to an unsafe condition or it has become obsolete, very uneconomical and stringent safety measures are and have been taken. Isolated and uninhabited sites in the plains and within valleys with high ground or mountainous perimeters have served this end. So also, strong structures with high safety factors have been neutralizing, "provided for blasts", where the above sites are inaccessible or the economic factors make it prohibitive. Though these measures have served to prevent harm to the general population and to valuable real and personal property, real and present danger always exists to the needed personnel. Aside from the use of all-metal imperforate thick shields between the exploding medium and the personnel doing the detonating, tremendous danger exists due to flying debris (fragments, firebrands, etc.) and from the flame or fire effects.

The effort to alleviate and eliminate harm to persons and property as outlined above, has led us to the development of our new explosive and fire shielding techniques which we believe are a breakthrough in hazard protection and prevention in the explosive, propellant and pyrotechnic fields. Until the instant invention, confinement of the explosion or fire in its entirety was the aim. Thus, the percussion forces resulting from the rapid release of energy caused conflagration and debris to be spread over a wide area. This required the specification of "quantity distance" which necessitates large areas of real estate to be set aside as buffer zones in order to achieve a safe environment. Our invention is a departure therefrom. We, according to our invention, confine 100% of the flying debris (fragments) within the immediate vicinity of the explosion and bleed or dissipate, and baffle the pressure differential to reduce the force thereof to a negligible level. By the use of our innovative shield, hazards of blasts and combustion will be reduced tenfold. With our invention, personnel working near hazardous material manufacturing, storage, demilitarization and demolition areas and those using and transporting hazardous materials will be able to survive resulting explosions, blasts, and fires of these materials with little or no personal harm.

SUMMARY OF THE INVENTION

Briefly, the present invention provides for the encasement of potentially explodable or spontaneously combustible material with a debris and fire confining and pressure-differential diffusing and heat-dissipating shield in the fields of use, manufacture, storage, transportation, demolition, demilitarization, etc. of explosives, pyrotechnics and propellants.

It comprises various methods and apparatus for confining the debris, the fireball, and diffusing the gases of exploding material and also dissipation of heat so that harm from resulting blasts and fires is confined to the immediate vicinity thereof.

The shield is comprised of a plurality of interspaced layers of steel grating, steel perforated plates, steel louvered panels or wire screening, either used singly or together as a composite. The steel grating and louvered plates have been found to serve better for catching fragments. The perforated plates, or panels, have been found to serve best to reduce blast overpressures and to attenuate explosives forces or nonexplosive conflagration. And, the screens have been found to serve best as large heat sinks to dissipate the heat of the blast and also to confine conflagration. Though a multitude of designs are possible for our innovative multi-layer shield by virtue of the alternative use of various forms of apertured plates, such as, either grating, perforated plates, louvered panels or screens, we, as will be explained below, have found various composite designs comprising the use of one or more of each of the above materials to be the most economical.

Our shield, in use, can be of any structured shape or form so long as it functions to catch explosive fragments, to reduce some of the blast overpressures, confine the conflagration, and to dissipate some of the heat created by the explosion. With the interposition of, or an overlap of a thin layer of moisture-repellant material, such as nonflammable plastic or treated paper, the shield can also be used as the exterior portion of manufacturing, storage, transportation, demolition, and demilitarization structures or means used with sheltering hazardous materials. It can be used as a complete shield structure within a structure or under plural shield structures within a structure. It can be used to encase machines, parts of machines and assembly lines where potential hazards exist either working with or on these materials. It can be used to encase individual or plural explosives, pyrotechnics, propellants or munitions for storage and transportation. And it is intended to reduce the hazards of massive destruction of above-ground, warfare, munition dumps and storage areas etc. where harm to persons and property is ever present.

When a blast occurs in a conventional, three-sided, reinforced, hardwall cubicle of a temporary storage or manufacturing facility, the result is commonly that which is depicted in FIG. 1 (Prior Art) of the drawings. The high pressures are relieved when the weakest part, or parts, of the structure gives way. The roof and entrance way fracture and blow off. The depicted "chunks" of debris compound the fragment and blast hazards. In contrast, if a shield embodying the present invention had been used in or as the structure, little or no damage would be evidenced because the blast would have been completely enclosed to thereby confine the debris and attenuate the blast pressure. Thus, the roof and entrance way would have remained intact. Our inventive concept relies on continuous and controlled venting of the explosion gases by means of staggered, out of line of sight, apertures in the shield so that continuous, controlled venting takes place from the time of detonation to the time that over-pressure has been equalized in the surrounding atmosphere. In short, our invention increases the time-temperature and time-pressure curing duration so that the abruptness of temperature and pressure peaks are reduced. Tests have been conducted to better illustrate the benefits of our invention. For example, a 4.2 white phosphorous mortar shell, when detonated, typically scatters the phosphorus over a 120 foot diameter area, and throws fragments from the round at least 1,000 feet. By contrast, a three inch thick shield having 4'×4'×4' dimensions and embodying the innovative features of the present invention was placed to enclose the same type and size shell. We exploded the shell and observed that the fire ball was reduced to 12 feet in diameter and all fragments and phosphorus particles were confined by the shield. Another shell of the same size and type was exploded in a 16'×16'×16' foot cubicle plywood structure made of $\frac{1}{4}$ inch thick 4 by 8 foot plywood sheets secured to a 2×4 inch skeleton structure with the studs and joists spaced 24 inches apart. It was demolished. Another equivalent 4.2 round was exploded in a duplicate 16 foot cubicle plywood structure with a shield constructed in accordance with the present invention surrounding the round and no relative damage occurred to the structure.

Tests conducted on a rectangular, box-shaped container for transporting 1400 high explosive primers to be used with 5.56 millimeter cartridges indicated that one primer would detonate and destroy the container by setting off a chain reaction or mass detonation of the other primers. Under the same test conditions, merely by replacing the solid, heavy top and bottom covers of the container with covers structurally embodying our innovative shield, the container was not destroyed. The container was reused, and only a few primers at the most, were initiated. The remaining primers, or fuses, were salvaged. The same nondestructive result was obtained in a test where five of the 1400 primers were simultaneously detonated.

Therefore, it is an object of the present invention to provide new apparatus and methods for reducing hazards to persons and property in the field of explosive, propellant and pyrotechnic manufacture, storage, transportation, demilitarization, demolition, and use.

Another object of the invention is to reduce the hazards in manufacture, storage, transportation, demolition and use of explosives, propellants and pyrotechnics by providing shielding apparatus and methods which locally confine the blast debris.

Still another object of the invention is to reduce the hazards in manufacture, storage, transportation, demolition, and the use of explosives, pyrotechnics and propellants by providing shielding apparatus and methods to prevent flame propagation.

A further object of the invention is to reduce the hazards in manufacture, storage, transportation, demolition and the use of explosives, pyrotechnics and propellants by providing shielding apparatus and methods to locally confine the debris and attenuate overpressure from blasts.

Still a further object of the invention is to reduce the hazards in manufacture, storage, transportation, demolition and the use of explosives, pyrotechnics and propellants by providing shielding apparatus and methods to locally confine the debris and fireball, attenuate overpressures, and dissipate heat of blasts resulting from detonation of such explosives, pyrotechnics, propellants and the like.

These and other objects and advantages will become apparent from the following detailed description of the invention when considered in conjunction with the drawings.

DESCRIPTION OF THE INVENTION

Figure 1:
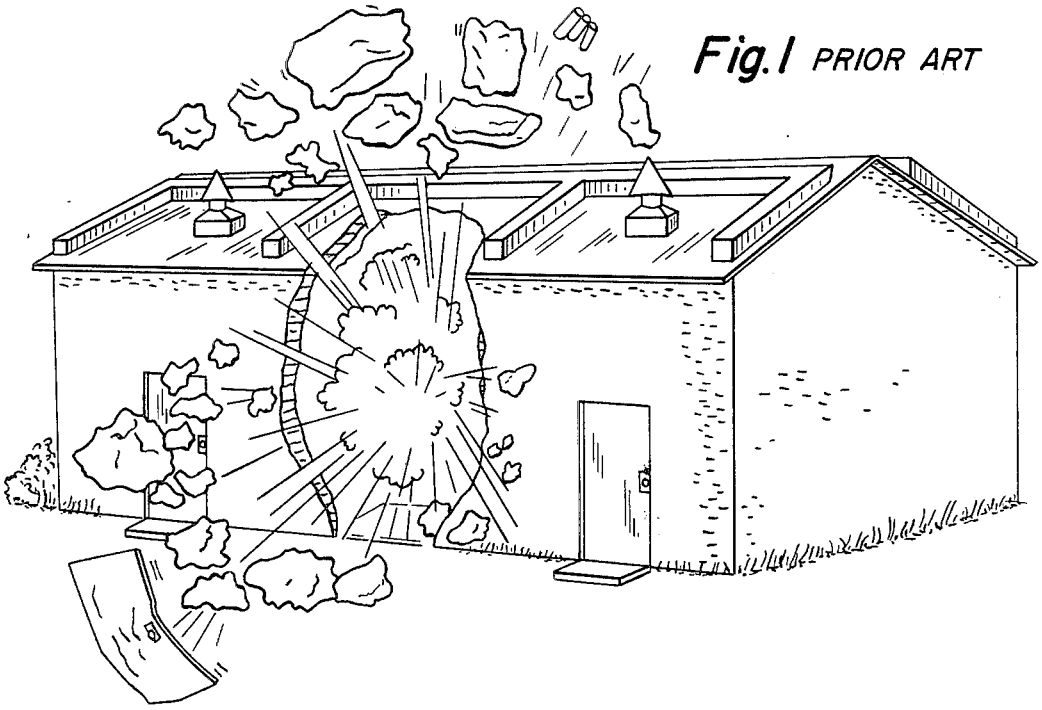
Fig. 1 PRIOR ART
FIG. 1 is an example of a prior art manufacturing or storage facility depicting the debris of a blast partially demolishing the facility.
Figure 2:
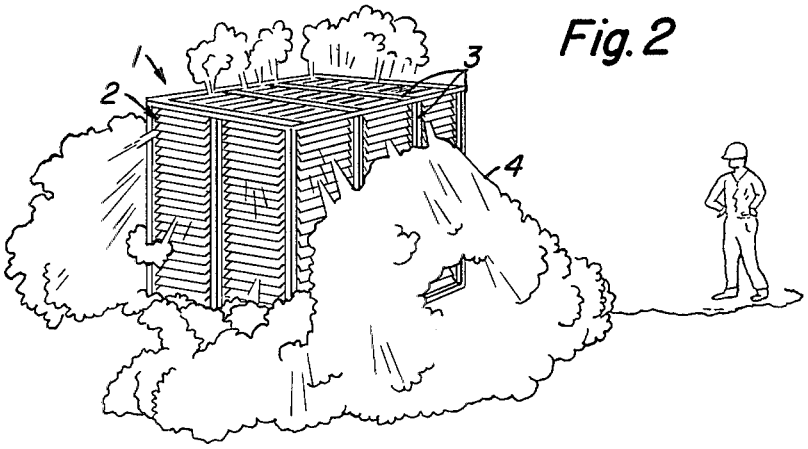
FIG. 2 depicts one aspect of the present invention embodied in a shield protecting a workman standing nearby from the debris and fire, the blast overpressure, and excessive heat of a blast.

Referring to FIG. 2, numeral 1 represents one form of our suppressive shield composite invention. It is comprised of metal shield sections 2 which are secured together at joints 3 by conventional means such as bolts, pins, screws, plates, etc. or as by the many varieties of weldments. Suppressive shield 1, as illustrated, has four sides and a top and if necessary can be secured by bolts, pins, screws, plates or welding to a permanent base, such as a floor or a support structure at the lower portion of each section 2. Also our innovative blast suppressive shield can include a floor structure made of sections 2, for example, if the situation dictates such a need. Access to the interior of our suppressive shield is by way of an entranceway (not shown) which is hinged and constructed of the same materials as sections 2. The entranceway can also be made in the form of a removable section which is either bolted, pinned, or screwed to the surrounding structure to close an opening provided in one of the sections 2. Shield sections 2 are made in sizes and shapes to permit handling and must function to contain blast 4 fragments, to baffle, attenuate and reduce blast 4 overpressure, to contain the blast 4 fireball and to dissipate heat of the blast. Various cross-sectional layered shapes can be used for this end. Conventional steel structural materials can be used.

Figure 7:
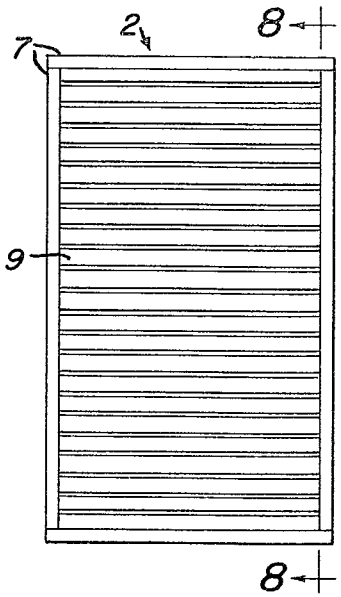
FIG. 7 is a plan view of a typical shield section of the invention.

FIG. 7 is an elevational plan view of a typical shield section 2.

Figure 8:
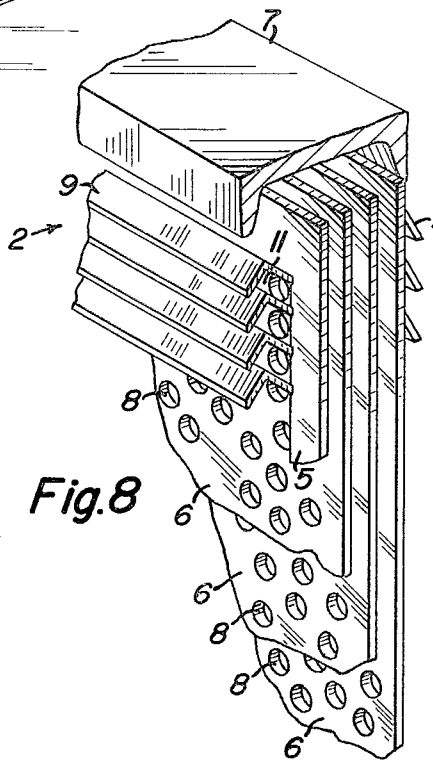
FIG. 8 is a fragmentary, perspective view taken along and in the direction of the sectional plane 8—8 in FIG. 7.

FIG. 8 is a partial isometric cross-section of FIG. 7 depicting one of numerous conceivable composites making up our innovative suppressive shield. Uppermost is channel beam 7 which forms a portion of the outer frame of shield section 2. Therebelow, is the composite shield made up of louvered plates 5 between which are spatially sandwiched apertures or perforated plates 6 and heat dissipation screen members (not shown) affixed to plates 5 and 6. For strength and integrity of the sections 2 and so also, to enable the sections to be secured together, it is preferable that members 7 completely surround the periphery of plates 5 and 6, as shown in FIG. 7. To enable our invention to accomplish the aforementioned features of confining the conflagration and debris, and reducing the overpressure of the blast, the plates must be laterally spaced and apertured. All apertures are staggered as viewing the plates laterally so that attenuation and baffling of the pressure can come about, and further, so that debris cannot traverse the entire extent of the composite. Louvers 9 are either struck from plates 5 to leave elongated slot apertures 11 or are made by securing a plurality of angle irons to plate 5. Plate or grate 6 has apertures which are staggered in relation to those of the next adjacent plate 6.

Figure 6:
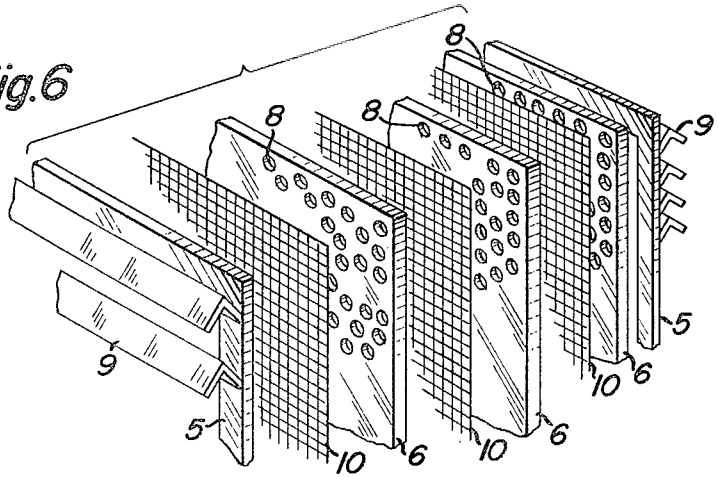
FIG. 6 is an fragmentary, exploded, perspective view of a corner portion of one of the many design varieties of the invention.

FIG. 6 is a corner portion of a shield composite depicted without peripheral support members, such as channel beams 7, and is depicted as an exploded perspective view for ready comprehension. Here, heat sink or heat dissipating screens 10 of metal are alternately disposed throughout the shield composite. As in FIG. 8, outer plates 5 with louvers 9 form the laterally opposite, outermost extents of the shield. Sandwiched therebetween, as previously described, are apertured plates 6 with apertures 8 of each plate staggered from the adjacent one for pressure attenuation and so also, for stopping debris and conflagration from penetrating the entire shield.

Figure 5:
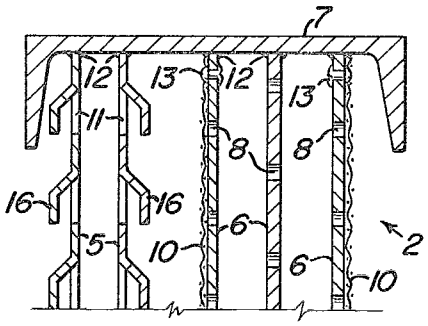
FIG. 5 is a cross sectional view of a composite shield of the invention terminated with a structural or channel beam affixed thereto.

The shield section of FIG. 5 is a modified version of those already, discussed. It is designed for heavy conflagration and debris attenuation. As in FIGS. 6 and 8, channel member 7 functions as an outer frame member. To it, plates 5 and 6 are affixed in end abutting relation at weldment 12. "Z" shaped louvers 16 are struck from plate 5 leaving elongated apertures 11. In this modification a pair of outermost, or leftmost, plates 5 are identically shaped but placed in back-to-back relationship. Spaced innermost from louvered plates 5 is plate 6 with heat sink screen 10 affixed thereto by rivets 13. Adjacent to leftmost plate 6 is another plate 6 with apertures staggered therefrom. Farther right, and spaced from the last-mentioned plate 6 is another plate 6 making up the outermost portion of the composite shield. Heat sink screen 10 is secured to the plate by rivets. This modification, when in use, preferably should be oriented so that the louvered plates 5 are nearest the blast area or potential blast area so that optimum results can be hand.

Figure 9:
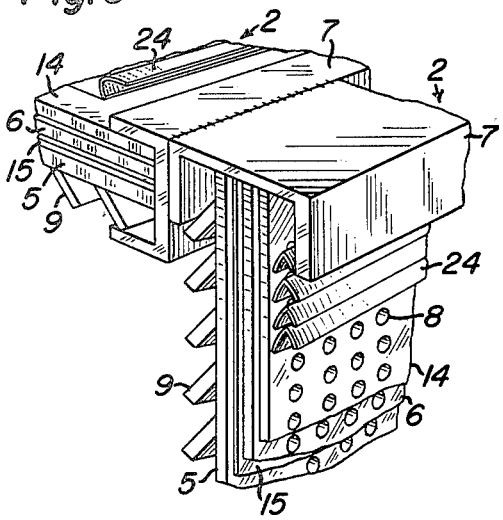
FIG. 9 is a fragmentary perspective view of two shield part sections forming a 90° joint.

The innovative shield modification fragmentarily depicted in FIG. 9 is a typical panel and roof-rail detail showing the weatherproofing or moisture prevention feature of the invention. Here, shield sections 2 are secured together at channel beams 7 with either bolts, rivets, or by weldments. Vertical shield section 2 is made of a composite having plates 5 and 14 with louvers 9 and 24, respectively, sandwiching plate 6 with apertures 8 and a thin sheet 15 of moisture impervious, nonflammable material such as "Mylar" interposed adjacent thereto. The "Mylar" sheet 15 should preferably be not greater than 0.007 inch thick. Other materials with suitable tear, heat and combustible characteristics will work as well. So also, metal foils of 0.001 of an inch or less in thickness have been found to work satisfactorily. Here, the vertical shield section 2 with its frame 7 can function as a load-bearing wall either internally or externally for a building. That is, it can replace normal studding and sheathing. Horizontally oriented shield section 2, and associated frame 7, can be an integral part of a building as well. It can function as joisting within a structure and so also as a roof per se. In the case of sheet material 15 it has been found critical that it have the tear and rupture characteristics which will not impede the function of the shield. That is, by withholding pressure and building it up the entire effect of the invention is destroyed. Moreover, in a blast the shield would be literally destroyed if sheet material 15 would even temporarily build up back pressure beyond shield strength. Hence, material 15 must be readily tearable, or shearable, or have weakened areas, or have openable portions to accomplish its end of being impervious to the elements without appreciably impeding blast pressure venting. It is understood that material such as that of 15, or the like, could be used in any of the invention modifications without departing from the breadth of the instant invention. Though not shown, the composite also contains at least one or more screen members (as depicted in FIG. 6), for purposes of heat dissipation and conflagration confinement, interposed between two or more of the plates or secured externally thereof. Horizontal shield section 2 is made up of a composite like that of vertical shield section 2.

Figure 10:
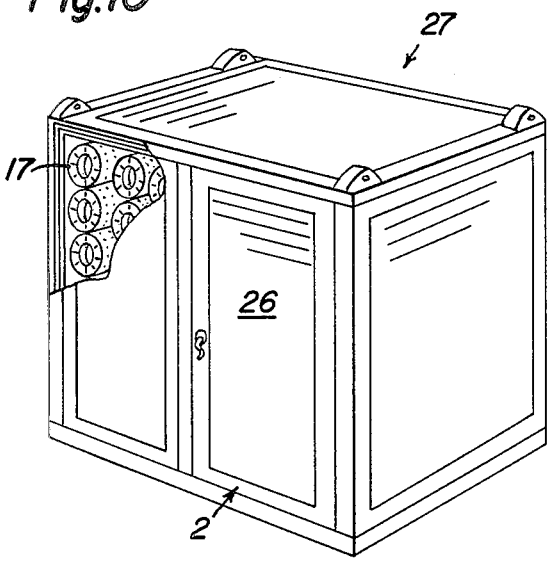
FIG. 10 is a partially fragmentary perspective view depicting the present invention embodied in a shipping container.
Figure 11:
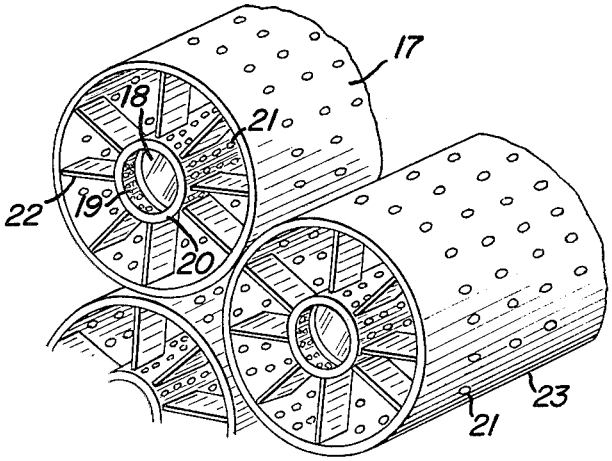
FIG. 11 depicts plural munitions encased by individual innovative shields of cylindrical shape.
Figure 16:
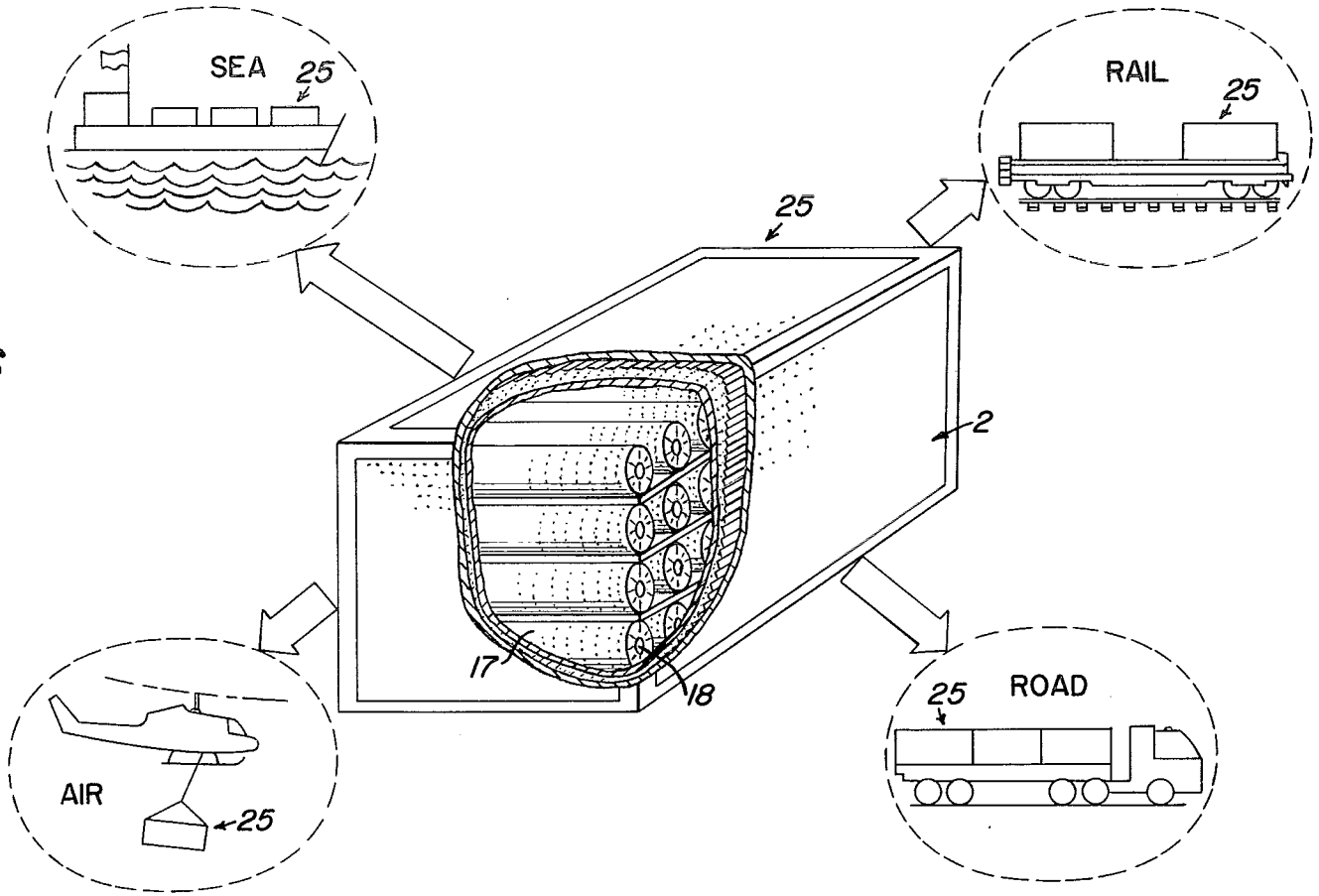
FIG. 16 is a munitions shield container having therein plural shielded munitions ready to be optionally transported by sea, rail, air or road.

The innovative shield modification 17 of FIG. 11 and shown in associated containerized use in FIG. 10 and 16 serves to isolate blasts and fragments between individual explosive, propellant, and pyrotechnic containing containers or munitions 18. As best shown in FIG. 11, shield 17 is shown with the above-mentioned munition or container moored in aperture 19. It is centrally held in central tube 20 which has baffle or pressure attenuation apertures 21. Multiapertured external, or outer, tube or housing 23 is the outermost portion of the shield. Studs, struts, or strips 22, of either high, heat-resistant plastic or metal having a relatively high melting temperature such as steel, tend to keep central tube 20 and outer tube 23 coaxial. Elements 22 can be frictionally held between the tubes or held as with rivets or bolts or by weldments. Tubes 20 and 23 can be made of metal, or fire-resistant plastic. Preferably, for economy, only one tube of each shield need be of metal for fragmentation arrestment. The length of the studs, struts or strips 22 partially suitable for a stack up of like containers can be determined by reference to the Department of the Army, U.S. Army Materiel Command, Regulation 385-100 which is entitled "Safety Manual for Spacing on a Line Various Rounds of Ammunition". The length also can be determined by computation or empirically. In operation, in the event of a blast of a container or munition moored in central tube 20, both tubes 20 and 23 attenuate the blast overpressure by way of their open ends and by way of apertures 21. By the use of this modification, it has been proven in tests that when a blast occurs in one container or munition, only it is destroyed and/or it and a few adjacent to it are destroyed. Thus, propagation of reaction is attenuated.

Referring again to FIGS. 10 and 16, the containers or munitions 18 are shown as being stored and packaged for shipment in shipping containers 25 (FIG. 16) and 27 (FIG. 10). As shown, the containers are respectively made of plural composite shield sections 2 of desired sizes and shapes which can have any of the cross-sectional configurations already discussed with respect to FIGS. 5–9. So also, many other composite shield combinations that will not depart from the invention, but will act to reduce blast overpressure, heat, conflagration and confinement of debris, are conceivable. The containers 25 and 27 can have at least one shielded section 2 with doors 26 (as shown in FIG. 10) so that containers and munitions 18, can be more conveniently inserted and transported. For example, they can be piled and packaged therein. The numerous well-known techniques of crating can be applied here by the use of a shield 17, for example, i.e., within a crating and shield such as that of 25 and 27.

Figure 14:
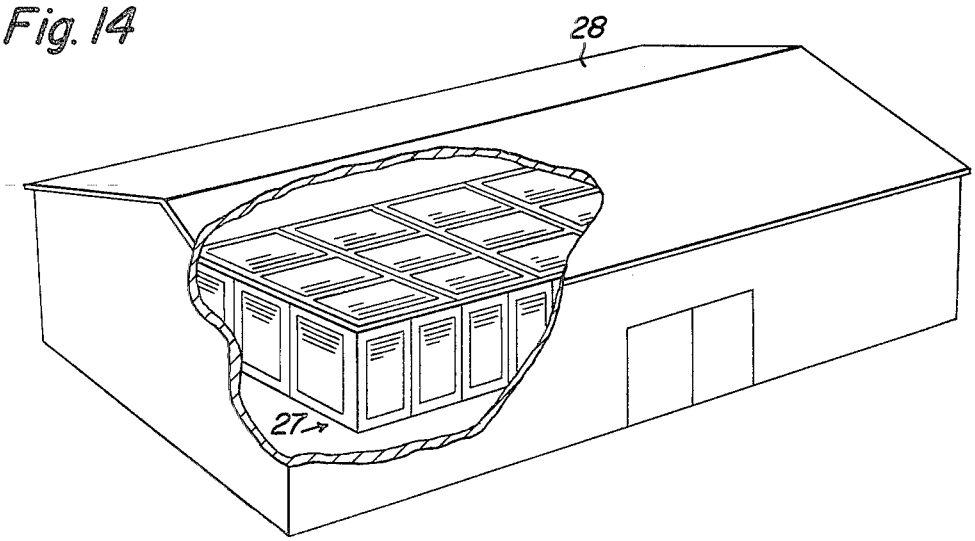
FIG. 14 shows a munition storage structure with a portion broken away to show plural munitions stored in shielded containers within the storage structure.

Referring to FIGS. 14, with our new techniques of packaging for shipment and storage, as above exemplified and depicted in FIGS. 10 and 16, now shield containers 27 can be stored safely in conventional buildings or warehouses 28 or in munition dumps. Moreover, for additional safety, though probably not warranted, it is within the purview of our invention to construct the building 28 entirely of shield material such as that, for example, depicted in FIG. 9. However, it is understood, of course, that numerous other shield cross-section composites other than those depicted in the drawings are perceived to be usable. They need not include element nonpermeable material 15 as described with reference to FIG. 9. Additionally it is within the realm of our invention to use weather and element-proofing material where desired and needed.

Figure 15:
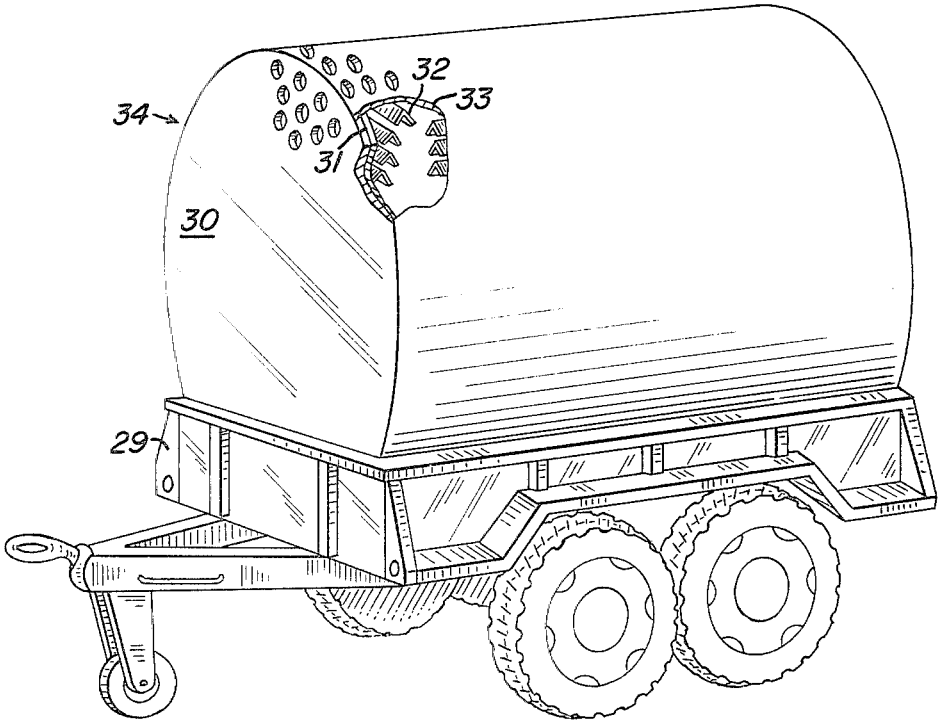
FIG. 15 shows a military transportation vehicle having a shielded compartment to carry munitions, explosives, pyrotechnics and propellants.

Referring to FIGS. 15 and 16, it is within the purview of our invention to design various types of transportation vehicles with explosive, pyrotechnic or propellant shielding per se or to be equiped with shielded compartments. An example is that of FIG. 15. The compartment 30 on vehicle body 29 is constructed as a shield. Here, perforated plates 31 with fragment stopping angle iron 32 are juxaposed and permanently affixed to perforated outer, arcuate plates 33 which comprise the outer shell of the compartment 30. The front end 34 of the compartment 30 is closed by and secured to the member 33 in any conventional way. Closing the rear end of the compartment 30 is a hingeable door assembly (not shown). The floor of the compartment 30, and so also the floor of the body 29, can be made of shield material so as to be capable of attenuating blast overpressure, confining a blast fireball and the debris, and dissipating heat thereof.

Figure 4:
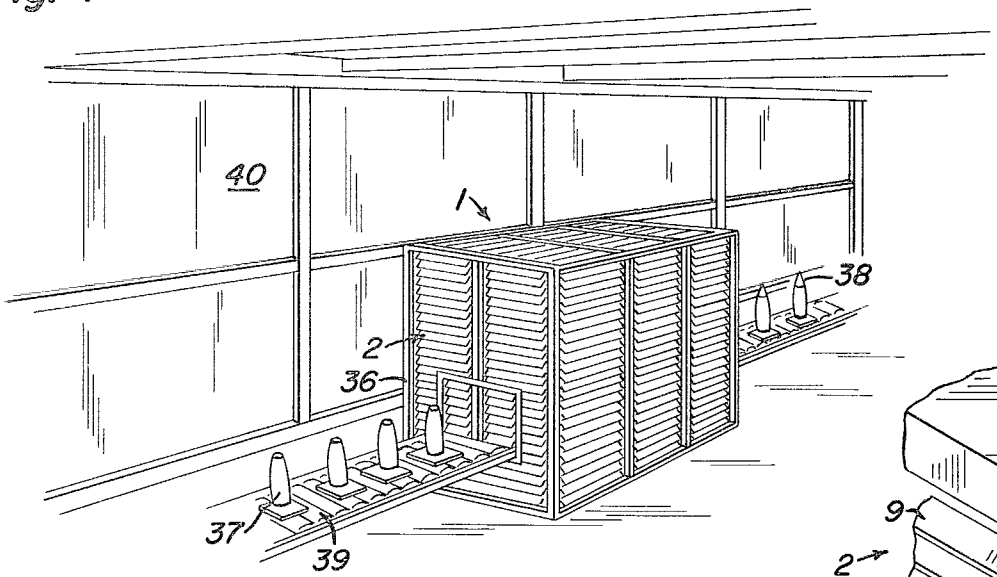
FIG. 4 is a perspective view of a portion of a munition assembly line within a manufacturing structure, depicting another embodiment of the present invention enclosing a machine performing an assembly operation.

Referring to FIG. 4, another version of our invention is depicted in the form of a suppressive shield 1 being used in a manufacturing assembly line. Shield sections 2 are affixed together and serve the same function as that described in FIG. 2. Note it has automatic access doors 36 which are step-by-step actuated as a travelling succession of shell casings 37 sequentially enter, by way of conveyor 39 and which confine the hazardous area within suppressive shield 1. Within suppressive shield 1 could be located a machine or plural machines performing operations such as mixing, filling, capping, or performing work on or with explosives, pyrotechnics and propellants, etc. In the instant illustration a projectile 38 is being secured to each of the shell casings 37 to render a completed munition. On the other end, or exit end, of suppressing shield 1 a similar set of exit doors 36 is provided. Though the manufacturing building 40 is of conventional design it is within the purview of our invention to make it of one complete shield if conditions dictate. Its load-bearing and structural features then would take the shape of those various cross-sections already described. So also, a plurality of these suppressive shields 1 for manufacturing operations could be located successively along the assembly line within one large structural shield. Or, the entire assembly line could be encompassed within a suppressive shield with separators spaced therealong so as to prevent propagation reaction blasts. The separators could function like the ends of suppressive shield 1 with hingeable doors 36 of FIG. 4, for example.

Figure 3:
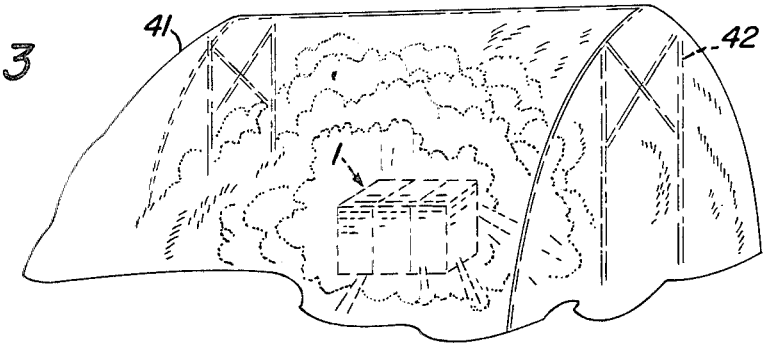
FIG. 3 depicts a demolition setup wherein a sealed outer Quonset hut style of shaped enclosure contains the disseminated chemical of an exploding chemical agent form of munition.
Figure 12:
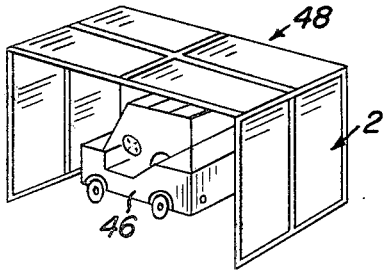
FIG. 12 depicts the present invention embodied in plural shield sections secured together for protecting equipment from the hazards of fire and blasts.
Figure 13:
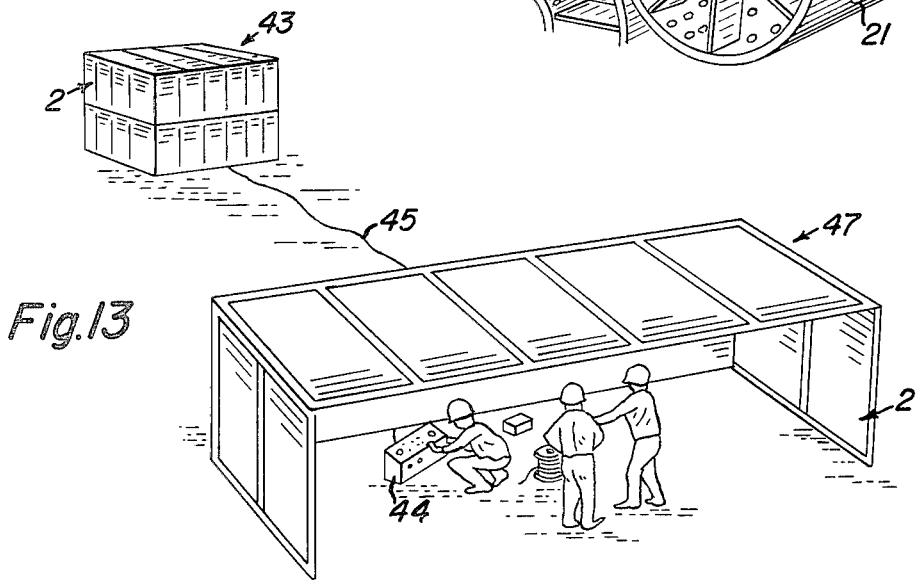
FIG. 13 depicts the shield of the present invention in the form of an enclosure for enclosing a munition to be exploded in association with a shield structure for protecting the equipment and demolition personnel.

Referring to FIGS. 3, 12 and 13, our invention also extends to the use, demilitarization and demolition of or with explosives, propellants, and pyrotechnics. FIG. 3 depicts a Quonset hut type of sealed exterior closure 41. It is for collection of chemical agent and must be of a nonpermeable nature. Element 42 represents the frame work to hold the seal in place. Within sealed enclosure 41 is our suppressive shield 1 which is representative of any of the numerous aforementioned composite cross-sectional configurations, or others. This shield unit 1 is used demilitarizing or for testing chemical munitions. That is, if a munition of lethal, or nonlethal, nature exceeds its useful life or must be tested it must be destroyed. Some such munitions cannot be dismantled per se. Hence, they are intentionally exploded in a confined environment. Here, the agent munition is exploded in suppression shield 1 to confine fragments and debris of the blast, to reduce or attenuate gas and agent blast overpressure, and to control the fireball and to reduce heat of the blast. The attenuated gas and agent velocity because of the shielding is reduced to a nondestructive level and collected in hut or enclosure 41. After the explosion, the confined gas is pumped off for disposal or pumped through gas purification apparatus. The munition detonation means and purification apparatus are not shown, however, any of the well-known techniques will suffice.

In the use, demilitarization and demolition fields, we have surrounded the explosive, propellant, or pyrotechnic and its structure or item to be demolished with our suppressive shield 43 as shown in FIG. 13. Connected to the mode of destruction, i.e., the explosive, propellant, or pyrotechnic means is a detonator-actuator 44 which is one of the many conventional units of that type on the market. That is, it can contain electrical means to convey current or energy along insulated electrical insulated wires 45 to the munition whereat it by various conventional actuators or detonators and primers will setoff the mode of destruction. For the protection of persons and property working with hazardous materials susceptible of creating fires and blasts, additional uses of our shield invention, besides confining the blast area, are anticipated. In this environment units 47 and 48 of FIGS. 12 and 13 are examples. They comprise directional shielding only. Note in FIG. 12 a shield unit 48 comprises plural shield sections 2 having one side open for ingress and egress of equipment 46. It, for example, shields equipment from destruction from blasts and fire. So also, note shield unit 47 of FIG. 13 which is comprised of plural shield sections 2 and only has shielding features on four sides to protect equipment 44 and personnel. The shield composites can be like those of any of the designs already discussed or deviations therefrom—the only criticality being—safety of that for which protection is sought.

Our invention in its various forms has as its objective, with a good degree of predictability, that of controlling the hazards associated with propellants, pyrotechnics and explosives. This is done by confining fires and by attenuating blast pressure to a safe level, confining the fireball and fragments to the immediate vicinity of the blast, and that of dissipating the heat of the blast. We have found certain criticalities do exist to make the use of our invention shielding more economical.

The following examples are illustrative of our invention in application.

EXAMPLE I

Design specifications for our invention of FIG. 6 in providing hazard protection from the 81 mm shell is set out below. The inner layer, or innermost louvered plate 5, (leftmost on the drawings) should be nearest the blast area. It should be constructed of perforated metal, expanded metal or of similar material which has a large venting area of from 25–60%. Here we have used $\frac{1}{4}$ inch thick angle irons 9 with one inch legs welded to a backing plate of like thickness. The function of this layer is to slow down, but not necessarily stop the major fragments of a blast. The second layer 6 is a perforated panel or plate which is 2/16 inch thick and perforated with holes 8 of approximately $\frac{1}{4}$ to $\frac{3}{8}$ inch in diameter located on one inch centers which acts as a secondary fragment attenuator and the first of the overpressure attenuators. It is spaced about $\frac{1}{4}$ to $\frac{1}{2}$ inch from plate 5. The next adjacent plate 6 is of like dimension but has holes 8 offset from those of the adjacent plate 6. This offsetting tends to further attenuate the blast overpressure and so also reduces the possibility of small fragments being thrust through the plurality of apertures 3. The second plate 6 is preferably spaced from the aforementioned plate 6 by $\frac{1}{4}$ to $\frac{1}{2}$ inch. The last plate 6, as we move rightward, has its apertures 3 out of alignment with those of the next adjacent plate but of the same relative size. It can have identical hole locations to that of the leftmost plate 6, for example. All plates 6 and 3/16 inch thick. Moving further to the right is another louvered plate 5 with its louvers 9. Located upon the blast side or leftmost side of each plate 6 is a fireball and heat attenuator screen 10. Each such screen is preferably secured to plate 6 by rivets; however, clips, bolts, weldments or localized brazing will suffice to hold same in place. The screen in this instant is conventional copper metal window screening. However, equivalent or other higher melting point metals will suffice for screening. This composite when provided with a frame member 7 as in FIGS. 8, 5, or 7, completes the components. Frame member 7 is a $2\frac{1}{2}$ inch channel iron with $\frac{5}{8}$ inch flange and weighs 2.27 pounds per foot. Welding, riveting, bolting, or bracketing the above-mentioned plates 5 and 6 to it, is contemplated. Preferably, the shield plates 5 and 6 and so also the screens are of the 4 feet by 8 feet dimension so that conventionally made structural shapes can be used. For protection from an 81 mm shell we designed the shield to withstand the explosion of six 81 mm rounds simultaneously. Each such shell has approximately 2 and 1/16 lbs. of explosive. Hence, in the manufacturing of 81 mm shells for the Department of The Army, shield 1 could be made of sections 2 as just described and depicted in FIG. 6 for example. So also, in the use, demilitarization, and demolition of 81 mm shells, sections 2 could be of the above construction to make up our suppressive shield of FIGS. 2, 3, or 13. Also, for additional personnel and equipment protection the shields 48 and 47 of FIGS. 12 and 13 could have sections made to the specifications just described. So also, the vehicle compartment 30 or the like of FIG. 15, when carrying 81 mm shells, could be made of a shield composite with the above-recited specifications. These same shield specifications could be used to render sections 2 of shields 25, 26, and 27 of FIGS. 10 and 14, 16, no matter whether they be used for transportation or storage. In designs to protect against hazards of the Department of The Army 81 mm shell it is also understood that the various applications can include the use of non-flammable weather-proofing, sheet material elaborated upon in FIG. 9.

EXAMPLE II

For the Department of The Army's 81 mm shell the following design specifications have given beneficial results for the use of the cylindrical shield unit embodiment of our invention set out in FIGS. 10, 11 and 16. Using the U.S. Army Materiel Command, Regulation Manual 385-100, for minimum spacing, it is found for this shell that the safe spacing between shells is 6 inches on center from shell outside diameter to shell to shell outside diameter. It has been found that 3/32 inch medium grade steel sheeting is the minimum necessary protective material between rounds. Hence, we have chosen for this shell an inner or central tube 20 which is 21 inches long, 3/32 inches thick, and of an inside diameter to fit the outside diameter of the shell. For venting and baffling purposes, apertures 21 should be ¼ inch in diameter and be provided on ⅝ inch centers. Struts or strips 22 can be of 3/32 inch thick metal or of equivalent column strength nonflammable—high melting point plastic at least 3" long. Outer tube 23, also 21 inches long, has a radius 3 inches larger than central tube 20. It is provided with ¼ inch apertures 21 on ⅝ inch centers. Struts or strips 22 can be secured in place by way of friction, adhesive, bolts, rivets or by weldments if appropriate. Outer tube 23, in this case is made of 3/32 medium grade sheet steel. However, as long as the aforementioned minimum thickness of metal is met, either the outer tube 23 or central tube 20 could be of nonfrangible, nonflamable, high melting point plastic or metal-plastic composition.

EXAMPLE III

Design specifications for transportation vehicles either made wholly or in part to embody our innovative blast suppressive shield are set out below. Because of our invention, i.e., fragment, debris and fire confinement, blast overpressure attenuation and heat dissipation features, the following design has been tested to enable explosive devices with 5 pounds or less of high explosive to be transported through populated areas with safety. Compartment 30 of FIG. 15 was provided with three parallel 3/16 inch thick perforated plates spaced approximately 3/16 inch apart to form the outer structure shell 33. Angle irons ¼ inch thick and with 1 inch legs are spatially welded to the innermost plate for debris and fragment confinement. Front 34 and the rear, not shown, are of like cross-sectional construction. A hingeable door of like construction (not shown) is provided in the rear portion. The floor is solid steel and over ½ inch thickness. All metals are standard building structural metals.

Our innovative shield in all its modifications, excepting that of the concentric cube type, should have the various layers of the composite free for at least limited movement. That is, the panels of the various sections need not be secured by spacers etc. uniformly across the major surfaces. So also, the design safety limit used currently is that of the elastic limit or yield point and not that of the plastic limit. In the design of our shield as an integral part of the load-bearing structure of a storage, manufacturing, or other type facility the outer frame members can be used as beams and columns. The shape and size of the entire shield structure is dependent upon use demands. Though conventionally available structural shapes can be used to make our suppressive shield, it is within the purview of our invention to use higher or lower grade steels, alloys thereof and other metals or nonmetals which display or could be made to display necessary characteristics. The shield may be made of one integral piece without sections if desired. Although, sections enable versatility of assembly, etc. they need not be used. As aforesaid, our suppressive shield may comprise plural screens per se, it may comprise plural louvered plates, it may comprise plural perforated plates, or it may comprise a combination of one or more of each of the above. Our suppressive shield may be of any configuration and may be of any thickness just so the objectives are attained. Our suppressive shield composite may consist of plural components secured only on the outer edges and/or they may be secured by way of interposed spacers, strips, studs or wedges randomly placed throughout the composite. The studs, spacers or strips may be frictionally held, bolted, riveted, welded or secured with adhesive or wedges. The shield composite when made into sections to be assembled into a unit suppressive shield may have external frame members or it may not.

The composite shield sections may be assembled by first cutting the frame members 7 to size (see FIG. 8). Then three sides of the frame can be formed and welded together. Then successively the various plates can be secured to the frame as by welding, bolting, riveting or bracketing. After all of the various plates including the screens are secured and assembled then the fourth frame member is welded, bolted, etc. to the section to complete the frame. Alternatively, the frames can be provided with matching, internal grooves to receive the plates, the screens, etc. of the composite. Hence, to assemble this section three frame members could be secured together at their ends to leave a bight and legs—then the shield members such as the plates, screens, etc. can be slid successively into the grooves. Assembly and securement of the last frame member then would complete the section assembly. Another method of assembling the shield composite sections would be to successively stack the plates and screens with the interposition of spacers, strips or studs and secure the composite thereby. Also, the frame members could be joined to the composite edges after the shield composite components have been laterally spaced.

In the case of making our tubular shield units of FIG. 11 the following procedures have merit. Central tube 20 and outer tube 23 can be perforated with apertures while in flat sheet form. Then when cut to length central tube 20 can have strips or studs 22 attached to one of its surfaces. Rolling central tube around with the attached studs outward on a mandrel of the size of the munition it is to hold will then bring the ends of the sheet into abuttment. After welding the central tube ends together, outer tube 23 can be formed by wrapping a properly sized sheet around the upstanding strips or studs 22 and securing the ends thereat. Securing the outer tube to the studs 22 then completes the shield. Alternatively, the tubes can be concentrically oriented and held thereat by securing studs 22 thereabout. So also, the tubes could be preshaped and one of them provided with the strips so that telescoping one into the other would render the completed assembly.

In summary, our invention encompasses a complete departure in the field of hazard control. It is to be understood that, although the underlying principles of the invention have been described with reference to simplified embodiments of various adaptions of the invention, many modifications may be made in designing different kinds of invention apparatus and of using our invention without departing from the spirit thereof. Therefore, we desire to be limited only by the scope of the appended claims.

We claim:

1. In a building with hazardous materials the improvement wherein said building includes at least one wall, ceiling or roof portion having a metal and gas venting shield comprising:
   - at least one perforated plate for overpressure attenuation means;
   - at least one metal louvered plate spaced from and adjacent to said perforated plate for slowing or confining debris;
   - fire confining and heat dissipating means in the form of at least one metal screen affixed to one of said plates.

2. A building for containing hazardous items including munitions, explosives, pyrotechnics, and propellants, wherein at least a portion thereof contains a blast suppressive shield comprising a multi-layer metal or metal-like composite which includes:
   - a first apertured plate in the form of a louvered plate suitable for slowing or confining blast debris and fragments;
   - a second apertured plate in the form of a perforated plate defining a plurality of gas flow apertures suitable for attenuating blast overpressure; and
   - means for mounting said first and second apertured plates in spaced apart and substantially fixed position relative to each other.

3. A building according to claim 2, wherein said first apertured plate has a venting area of 25% to 60%.

4. A building according to claim 2, wherein the apertures in said plate for attenuating blast overpressure comprise round holes of about $\frac{1}{4}$ to $\frac{3}{8}$ inch in diameter on about one inch centers.

5. A building according to claim 4, wherein said plates are spaced about $\frac{1}{4}$ to $\frac{1}{2}$ inch from each other.

6. A building according to claim 2 or 3, wherein at least one metal screen for attenuating heat and fire is affixed to at least one of said plates.

7. A building according to claim 2, wherein a thin, rupturable sheet of non-flammable, moisture non-permeable material is positioned adjacent at least one of said plates.

8. A building as defined in claim 3, wherein said first apertured plate is disposed nearer said hazardous items than said second apertured plate.

9. A building according to claim 8, wherein said blast suppressive shield comprises a plurality of second apertured plates for attenuating blast overpressure, and wherein the apertures in at least one of said second apertured plates are staggered in relation to the apertures in another one of said second apertured plates.

10. A building for containing hazardous items including munitions, pyrotechnics, propellants and explosives, wherein at least a portion thereof contains a blast suppressive shield comprising a multilayer metal or metal-like composite which includes:
   - an outer frame,
   - at least one layer nearest the blast source for slowing or confining major blast fragments comprising a louvered plate,
   - at least one layer for attenuating blast overpressure, said layer being positioned rearwardly of said layer nearest the blast source and consisting essentially of a perforated plate containing a plurality of gas flow apertures, wherein said layers are secured to said outer frame in spaced apart, substantially fixed position relative to each other.

11. A building according to claim 10, wherein the layer nearest the blast source has a venting area of 25% to 60%.

12. A building according to claim 10 or 11, wherein the blast shield comprises a plurality of said blast overpressure attenuating plates, and the apertures in at least one plate are staggered in relation to the apertures in an adjacent plate.

13. A building according to claim 10 or 2, wherein the layer for slowing down or confining major blast fragments comprises parallel louvers.

14. A building according to claim 13, wherein the louvers are V-shaped or Z-shaped in transverse cross-section.

15. A building according to claim 10, wherein plural multilayer composites are secured together at said frames.

* * * * *